US006102261A

United States Patent [19]

Tsai

[11] Patent Number: 6,102,261

[45] **Date of Patent: *Aug. 15, 2000**

[54] PANTS HANGER

[76] Inventor: Daniel Tu-Hsien Tsai, 7033 Burnside Dr., San Jose, Calif. 95120

[ * ] Notice: This patent issued on a continued prosecution application filed under 37 CFR 1.53(d), and is subject to the twenty year patent term provisions of 35 U.S.C. 154(a)(2).

[21] Appl. No.: 09/097,416

[22] Filed: Jun. 15, 1998

[51] Int. Cl.[7] ..... A47G 25/48

[52] U.S. Cl. ..... 223/96; 223/95

[58] Field of Search ..... 223/96, 95, 93, 223/91, 90, 85; 24/520, 530, 545, 560

[56] References Cited

U.S. PATENT DOCUMENTS

| | | | |
|---|---|---|---|
| 707,192 | 8/1902 | Aiken . | |
| 853,527 | 5/1907 | Tye . | |
| 2,127,333 | 8/1938 | Hall . | |
| 2,408,145 | 9/1946 | Johnson | 223/96 |
| 2,431,976 | 12/1947 | Ajax | 223/96 |
| 2,492,325 | 12/1949 | Schroeder . | |
| 2,806,641 | 9/1957 | Rowe | 223/96 |
| 2,889,092 | 6/1959 | Gibron | 223/96 |
| 2,893,614 | 7/1959 | Rowe | 223/96 |
| 2,952,367 | 9/1960 | Creveling et al. . | |
| 3,333,711 | 8/1967 | Helmer et al. | 223/96 |
| 3,603,491 | 9/1971 | Weight | 223/96 |
| 4,034,903 | 7/1977 | Batts | 223/96 |
| 5,579,965 | 12/1996 | Turner | 223/96 |
| 5,607,066 | 3/1997 | Hebberd . | |

*Primary Examiner*—Bibhu Mohanty
*Attorney, Agent, or Firm*—Leonard Heyman

[57] ABSTRACT

A pants hanger, which is mounted on a vertical surface or is used to assemble into pants hanging array for hanging multiple pairs of pants, consists of a fixed horizontally extended base arm, a horizontally extended gripping arm and a spring element biasing the gripping arm against the base arm. The spring element is attached at the center of the gripping arm and allows for rotation of the gripping arm on the spring element to provide a substantially even pressure against an article of clothing supported between the base arm and the gripping arm. The base arm and gripping arm have a recess portion to allow for the increased thicknesses of pants along their seams. The unit may be combined with other like units to provide an array of hangers, disposed either horizontally or vertically.

12 Claims, 6 Drawing Sheets

PANTS HANGER

BACKGROUND OF THE INVENTION

This invention relates to a hanger for one or more pairs of pants, in particular, it relates to a pants hanger having a stationary member and a spring biased gripping member which provides evenly distributed pressure against the stationary member for gripping a pair of pants between the two members.

Numerous types of pants or trousers hangers have been disclosed over a long period of time. U.S. Pat. No. 707,192 issued to Aiken describes a trousers supporter having parallel rods. The spacing between two rods is barely sufficient to receive the four thicknesses of the trousers material but not wide enough to receive eight thicknesses of material which occurs at the seam portion at the extreme end of the trouser legs. Since this hanger is not adjustable, it is limited to certain trousers with a specific material thickness. This limitation makes this type of hanger unsuitable with the wide variety of materials and thicknesses now available.

U.S. Pat. No. 2,492,325 to Schroeder describes a combination hanger comprised of plurality of spaced parallel arms. The arms are spaced to receive the cuffs of men's trousers between an adjacent pair, however other garments can be draped over the arms as well. Since the arms are fixed with respect to each other, this pants hanger suffers from the same limitation as the above pants hanger with regard to the intended method of supporting pants. As to draping garments over the arms, the lack of a gripping arm requires careful balancing of the garment over the arm to prevent the garment from sliding off and falling to the floor, where it will inevitably become wrinkled or soiled.

U.S. Pat. No. 4,557,407 to Bogaczyk describes a pants hanger having parallel bars in which a pair of pants are held between a pair of bars by the friction force between the surface of bars and pants. This technique is very sensitive to the fabric materials or fabric thickness and is likewise not suitable for hanging wide variety of pants.

U.S. Pat. No. 853,527 to Tye discloses a trousers hanger with a plurality of fingers proximally mounted to a plurality of corresponding pins which are parallel to each other and vertically disposed, enabling the distal end of each finger to swing horizontally. The distal ends of the first and last fingers are urged together by a compressed spring between the extended proximal ends of the two fingers on the opposite side of the pins. Since only the distal ends of the fingers are compressed together, this hanger does not provide a uniform compressive force against the length of the pants legs. As a result, the weight of the pants pulling on one side can pull and stretch the pants material with undesirable results.

U.S. Pat. No. 2,127,333 to Hall et al. discloses a garment hanger with a plurality of pairs of fingers. Each pair of fingers are connected at a proximal end to each other and are free at the distal ends. Furthermore, the free ends of each pair are compressed together by a bolt and nut adjacent the proximal end of the gripping fingers. Since the other ends of the gripping fingers are pivoted fixed in both patents, the techniques do not provide uniform compress force against the length of the trousers legs. This patent suffers from the same disadvantage as the previous patent, in that only the distal ends of each pair are compressed together, which can result in misshaped pants due to uneven stretching and pulling of the fabric.

U.S. Pat. No. 5,607,066 to Hebberd discloses a pants rack assembly having two rigid outer fingers and two floating inner fingers which are pressed against the outer fingers by two springs disposed between them. The springs are supported by an additional spring support arm disposed between the two inner fingers. This patent can support two pairs of pants between two finger gripping members but it requires a middle spring support arm which increases manufacturing costs and thus increases the price of the assembly. Additionally, the presence of the two coil springs prevent a person from draping a garment, such as a skirt, necktie, or other item, over one of the inner fingers. If several of these assemblies were to be placed next to each other, it would be difficult to figure out which fingers are stationary and which fingers are floating to determine which way drape the article of clothing.

Accordingly, none of the prior art hangers provide a simple construction for providing even pressure two arms to grip and hold a pair of pants between them. It is therefore an object of this invention to provide a pants hanger which simplifies the pants hanging process and suffers from none of the disadvantages of the prior art. It is another object of the invention to provide a modular hanging unit that can be easily assembled into hanging array for hanging multiple pairs of pants. It is also an object of the invention to provide an integrated hanging rack for hanging multiple pairs of pants. It is yet another objective of this invention that extend the above mention objectives to hanging skirt, neck tie and other items. It is finally an object of this invention to provide all of the features in a device which is inexpensive to manufacture.

SUMMARY OF THE INVENTION

The present invention is directed to a pants hanging unit which is may be mounted to a vertical surface, such as a wall, other surface, such as a shelf, or is used to assemble into pants hanging array for hanging multiple pairs of pants on wall or under closet shelf. The pants hanging unit has a horizontally extending fixed base arm, gripping arm, and a spring element, which biases the gripping arm against the base arm. The spring element is attached to the proximal end of the base arm at one end and to the center of the gripping arm at the other end. Since the gripping arm can rotate freely on a vertical axis with respect to the second end of the spring element, and since the spring is attached at the center of the gripping arm, the gripping arm exerts a substantially uniform compressive force against the base arm regardless of the thickness of the material held between the base arm and the gripping arm. In use, a pair of pants are slid in from the front, or distal, side, between the base arm and the gripping arm and are held vertically in the unobstructed region between the inner adjoining surfaces of base arm and gripping arm by the biased force exerted from the spring element. The front ends of the base arm and the gripping arm have a gradual slanting surface to assist in sliding a pair of pants into position. There is a double seam recess region between base arm and gripping arm to accommodate thicker double seam portion of a pair of pants.

The present invention allows the gripping arm to travel not only parallel to but also at an angel to the base arm to facilitate pants hanging process. This structure enables a pair of pants be slid into position directly or be slid into position while the front end of the gripping arm has been partially pushed away from the base arm to eliminate crumpling of a soft garment during initial insertion.

In addition, a pair of pants may be freely placed into the final position while the gripping arm has been fully pushed away from the base arm. In this case the gripping arm is released to a resting position. In this manner, any possibility of blemishes caused by rubbing a garment against gripping arms is eliminated, which is extremely desirable in hanging delicate garments.

The design also prevents belt loops at the waist portion of pants from tangling with gripping fingers during insertion and is suitable to hang a pair of pants with leg side up or waist side up.

The base arm and gripping arm may be fabricated from wood, plastic or metal and the spring element may be a wire spring, flat spring or other suitable material. Also, the pants hanging unit can be scaled to any desired size for different hanging applications.

The base arm and spring element can be integrated into one combined structure. For example, the base arm and spring element can be integrally formed as a single piece of plastic.

Additionally, this invention is extended to include a common base arm which receives two gripping arm assemblies, which comprise a gripping arm and associated spring element, positioned to the left side and to the right side of the common base arm to hang two pair of pants. This reduces the number of components and increases hanging density. Furthermore, this invention is also extended to include a base carrier with integral base arms and/or common base arms to receive multiple gripping arm assemblies in one integrated unit.

Additionally, the gripping arm assembly may be positioned substantially above the base arm to prevent a garement from sliding off the base arm when it is draped over the base arm. This is especially advantageous when there is limited vertical space available to support the garment at the waiste or bottom of the legs.

DESCRIPTION OF THE PREFERRED EMBODIMENTS

The invention will now be particularly described with reference to the several preferred embodiments in conjunction with the accompanying drawings.

Figure 1:
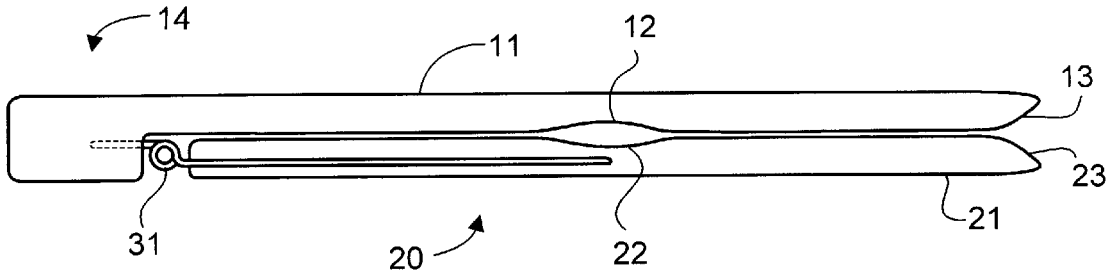
FIG. 1 shows an assembled pants hanger in top view.

Referring now to FIG. 1, there is shown a top view of an embodiment of the present invention including a horizontally extended base arm 11 and a gripping arm 21. The gripping arm 21 is positioned side by side and parallel to the base arm 11. Base arm 11 and gripping arm 21 may be made of molded plastic or the like, or formed from wood or metal. Spring element 31 provides a biasing force, pressuring gripping arm 21 against base arm 11. FIG. 1 and subsequent figures show base arm 11 and gripping arm 21 separated by a slight gap only for purposes of showing the distinct parts. In reality, base arm 11 and gripping arm 21 are in contact with each other due to the force of spring element 31. Spring element 31 is made from any material but preferably spring wire which is strong enough to provide sufficient transverse force on to gripping arm 21 to hold a pair of pants vertically between gripping arm 21 and base arm 11 and yet resilient enough to permit it to be deformed sufficiently to separate gripping arm 21 from base arm 11 for insertion of the garment between the arms. Flexible molded plastic, stamped flat spring, or other strong, resilient material can be used as a substitute for a metal wire spring.

Figure 2:
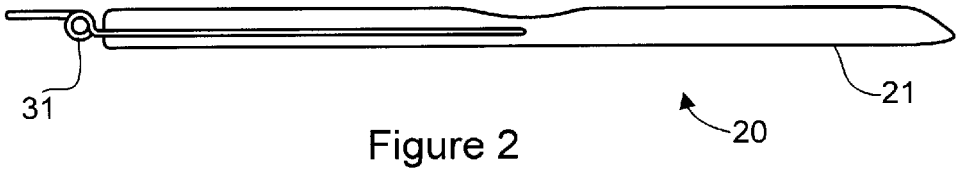
FIG. 2 shows a gripping arm assembly, including the gripping arm and spring elements, in top view.
Figure 3:
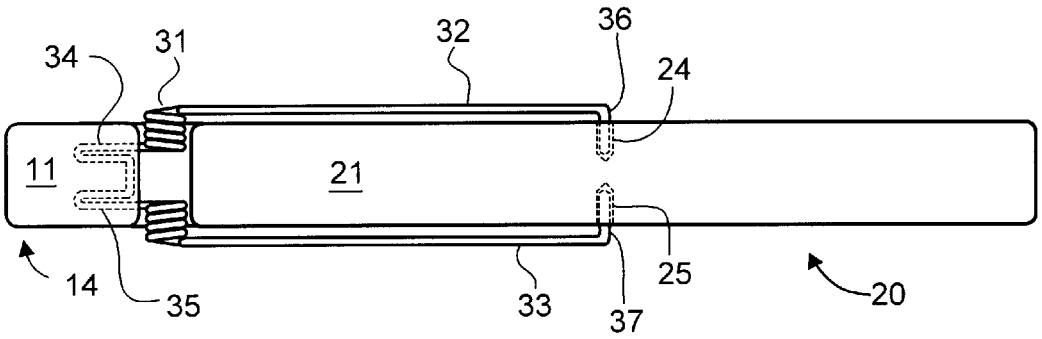
FIG. 3 shows the assembled pants hanger of FIG. 1 in profile.

Gripping arm assembly 20 is shown separately in FIG. 2, and comprises both the horizontally extended gripping arm 21 and spring element 31. FIG. 3 shows the first embodiment in profile view. Here, an upper recess hole 24 and a lower recess hole 25 are shown on the top side and the bottom side of the gripping arm 21, respectively. These recess holes provide a vertical pivot connection to the spring elements 31. Spring element 31 is a torsion type spring formed from a single spring wire and having an upper section 32 and a lower section 33. Inwardly turned pivotal terminals 36 and 37 of the torsion spring sections 32 and 33 respectively are pivotally seated in the recess holes 24 and 25 located at the top and bottom of the gripping arm.

Connection terminals 34 and 35 of upper and lower torsion spring sections 32 and 33, respectively, are permanently imbedded into the rear region 14 of the base arm 11.

Terminals 34 and 35 are imbedded either at the time of molding base arm 11 or base arm 11 is formed of two pieces which are radio or friction welded together, permanently holding terminals 34 and 35 in place. Alternatively, terminals 34 and 35 could be press fit into slots (not shown) formed in base arm 11.

Figure 4:
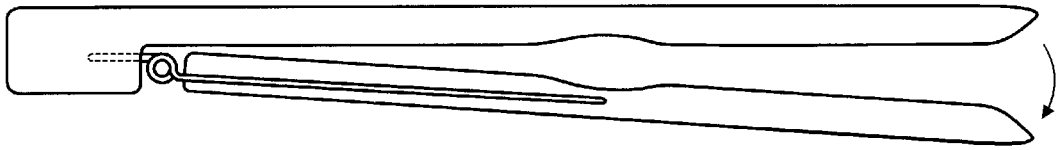
FIG. 4 shows the assembled pants hanger of FIG. 1 in top view with the distal or front end of the gripping arm pulled away from the base arm.
Figure 5:
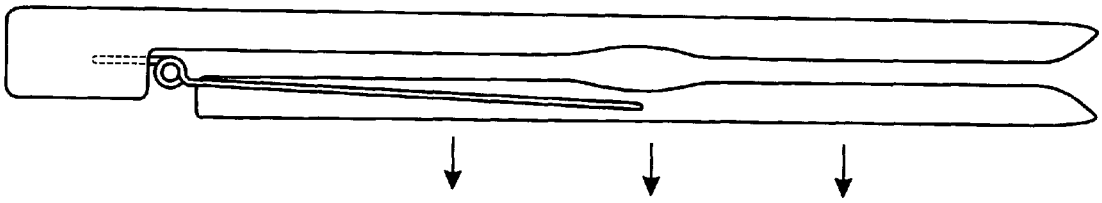
FIG. 5 shows the assembled pants hanger of FIG. 1 in top view with the gripping arm separated from the base arm.

The spring element 31 biases the gripping arm 21 toward the base arm 11 and also permits gripping arm 21 to move transversely and rotationally in the horizontal plane with respect to base arm 11, as shown in FIGS. 4 and 5. A pair of pants may be held vertically in the unobstructed compression region between the opposed inner faces of base arm 11 and gripping arm 21.

As seen in FIG. 1, the inner faces of the base arm 11 and the gripping arm 21 have recess regions 12 and 22 respectively to accommodate a thicker seam portion of pants legs. Recesses 12 and 22 are optional and need not be located in the center of the base and gripping arms 11 and 21. The inner faces may also have horizontal grooves, a bump pattern, felt, or other friction enhancing measure formed or affixed therein to increase friction between a pair of pants and the inner faces of gripping arm 21 and base arm 11. The front end of base arm 11 and gripping arm 21, shown in the figures on the right side of the page, the have gradual slanting surfaces 13 and 23 respectively to facilitate pants insertion.

Figure 6:
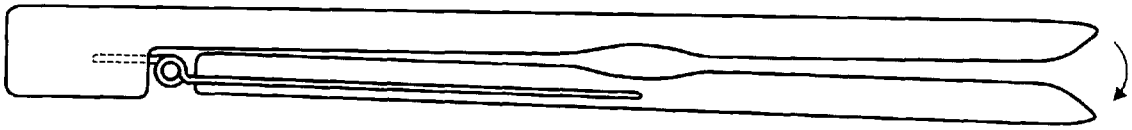
FIG. 6 shows the assembled pants hanger of FIG. 1 in top view with the distal end of the gripping arm pulled away from the base arm.

The present invention enables the gripping arm 21 to move not only at an angle to but also transverse to the base arm 11 to facilitate pants hanging process. This structure permits a pair of pants to be slid into position directly or be slid into position with the front end of the gripping arm being partially pushed away from the base arm to eliminate crumpling of soft garment during initial insertion, as shown in FIG. 6.

Furthermore, a pair of pants may freely be placed into the final position with the gripping arm 21 pushed away at large angle to or fully pushed away from the base arm 11 as shown in FIGS. 4 and 5. The gripping arm 21 is the released to its resting position to hold a pair of pants in vertical position. This attribute not only simplifies pants hanging procedure but also eliminates rubbing of garment against hanging arms and is extremely desirable for hanging delicate garments.

Base arm 11 can be secured to a wall, shelf, or other surface or article in any known manner, such as by screwing the base arm to the wall. Any convenient part of base arm 11 can be secured to the surface or article, such as rear portion 14 or the arm itself.

Figure 7:
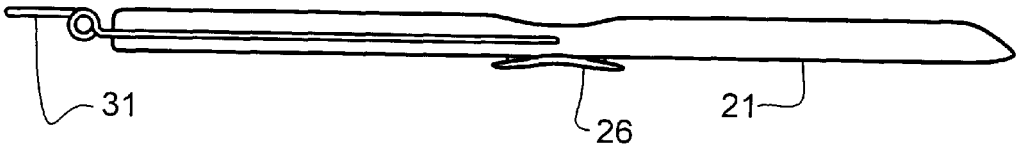
FIG. 7 is a top view of an alternative embodiment gripping assembly having a push tab.
Figure 8:
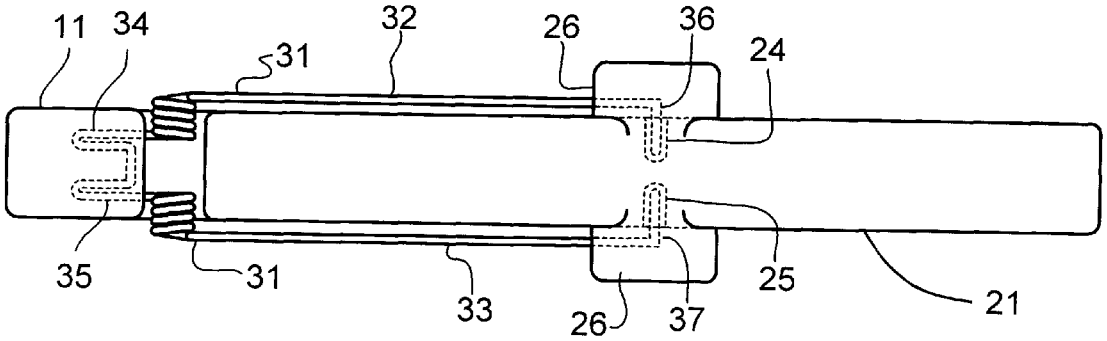
FIG. 8 is a profile view of a fully assembled hanger incorporating the gripping arm assembly of FIG. 7.

FIGS. 7 and 8 show an enhancement that can be made to the hanger of FIG. 1. Specificallly, pushing tabs 26 extending vertically from the center of gripping arm 21 are added to facilitate pushing griping arm 21 away from base arm 11 to simplify pants hanging. By providing pushing tabs 26 both on top and bottom of gripping arm 21, the hanger may be mounted with gripping arm 21 on either side of base arm 11. Instead of being at the center of the gripping arm, the pushing tabs 26 may be placed towards the front or other desired position on the gripping arm.

Figure 9:
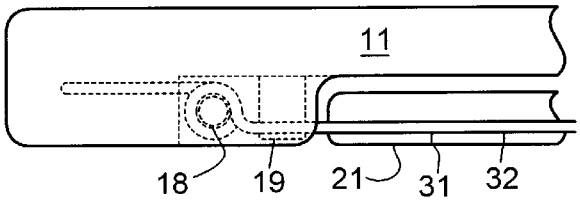
FIG. 9 is a detail top view of an alternative construction of rear or proximal portion of the base arm.
Figure 10:
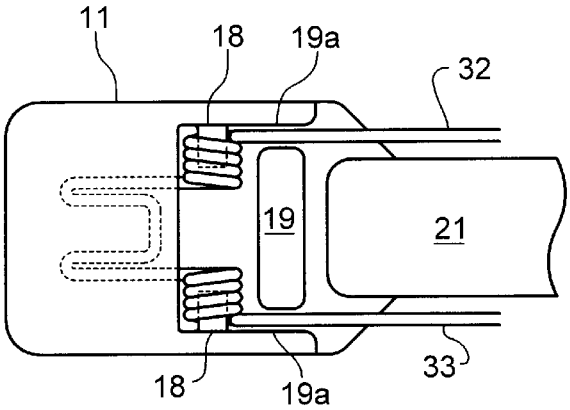
FIG. 10 is a profile view of the detail shown in FIG. 9.

FIGS. 9 and 10 show another enhancement which can be incorporated into the hanger. FIGS. 9 and 10 show a detail view of the rear portion of the hanger in top view and profile view, respectively. As can be seen, the rear portion of the base arm extends above and below spring element 31 providing support surfaces 19 and 19*a* against which spring element 31 can rest in the case that the hanger is supporting a heavy garment. Additionally, posts 18 are provided to maintain the coils of spring 31 in position, further stiffening the springs and preventing unwanted deformation of the spring, and also preventing spring element 31 from sliding out of base arm 11.

Figure 11:
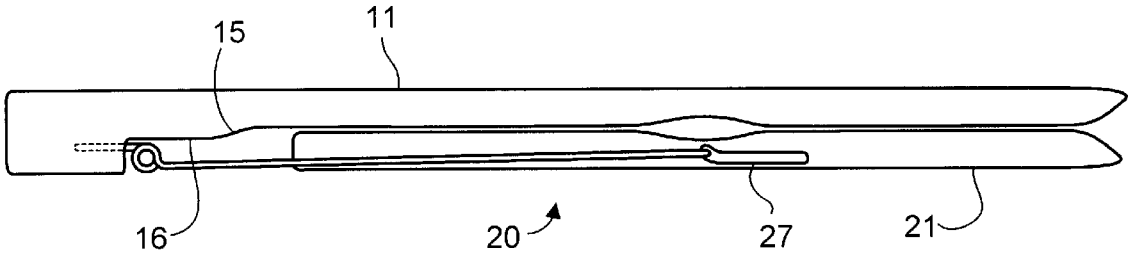
FIG. 11 is a top view of a second embodiment of a pants hanger having grooves in the gripping arm and a ramp on the base arm enabling the gripping arm to travel back and away from the base arm, allowing a person to easily hang delicate garments.
Figure 12:
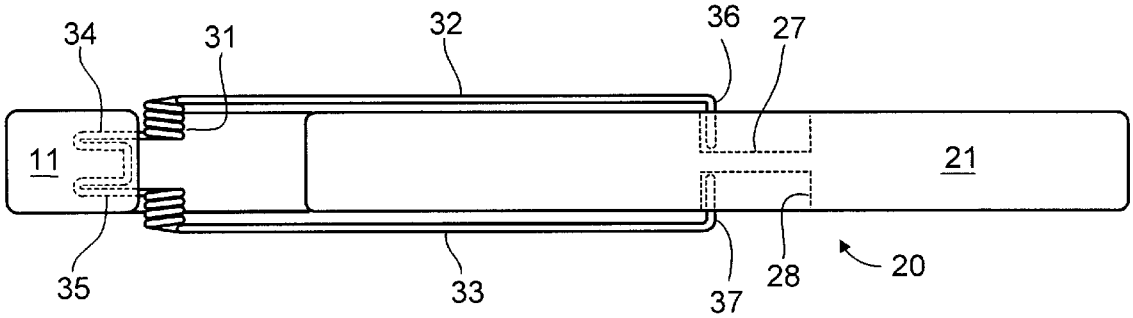
FIG. 12 shows the pants hanger of FIG. 11 in profile view.
Figure 13:
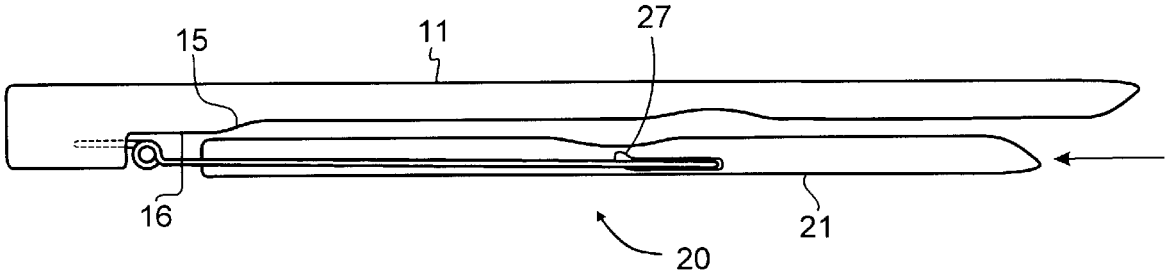
FIG. 13 shows the hanger of FIG. 11 with the gripping arm pushed back to separate the proximal or rear ends of the arms to make the insertion of delicate fabrics easier.

FIGS. 11, 12 and 13 show another enhancement which might be desirable for hanging delicate garments, in which the gripping arm 21 has spring grooves 27 and 28 located on the top side and bottom side, respectively, of gripping arm 21. Inwardly turned pivotal terminals 36 and 37 of the spring element 31 are seated in spring grooves 27 and 28, respectively, and slide in the grooves when gripping arm 21 is pushed inward or outward. There is a ramp 15 and a landing zone 16 located in the rear region of the base arm 11. When the gripping arm 21 is pushed inward, it glides on the ramp 15 and moves away from the base arm 11 as shown in FIG. 13. A space between base arm 11 and gripping arm 21 is formed when the gripping arm 21 rests on the landing zone 16 and allows a garment to be freely be placed into the final position, as shown in FIG. 13. In addition to being appropriate for hanging delicate garments, this structure permits the spacing between two adjacent gripping arms to be reduced, increasing pants hanging density.

Figure 14:
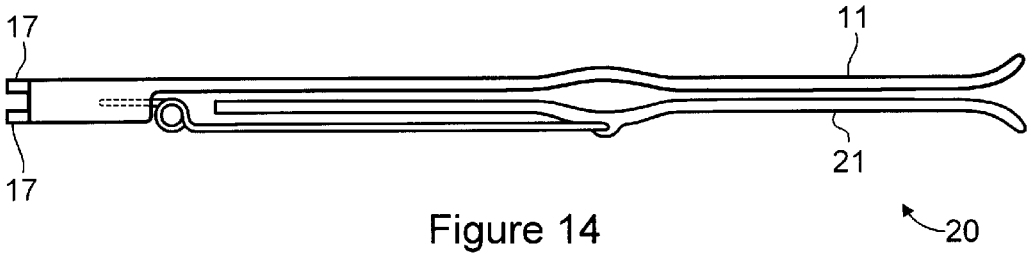
FIG. 14 is a top view of another embodiment of a pants hanger having bracket that is modular.
Figure 15:
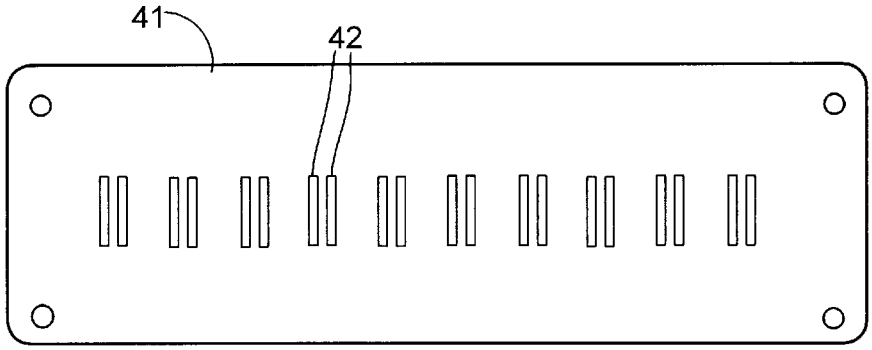
FIG. 15 shows the face of a wall bracket having slots to accept the pants hanger of FIG. 14.
Figure 16:
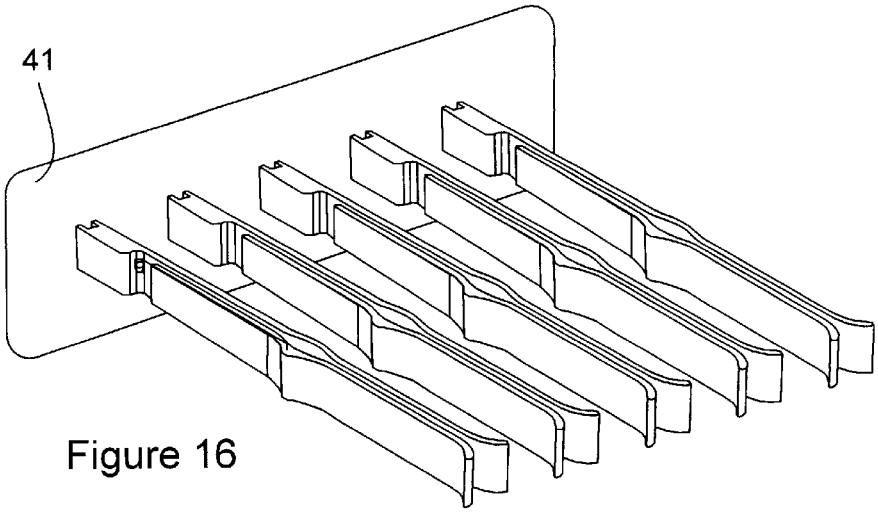
FIG. 16 shows in perspective view a plurality of the modular wall units of FIG. 14 mounted to the bracket of FIG. 15.

FIG. 14 shows a top view of another embodiment of the present invention implemented as a modular pants hanging unit made from metal material. Of course, any embodiment of this invention can also be implemented as modular units. This embodiment may be formed from any desirable material but especially desirable results may be obtained if cast in brass, formed from extruded aluminum or stamped from sheet metal. In a sheet metal embodiment, the gripping arm would be stamped with several longitudinal cuts which then provide strips which are then expanded to receive spring element 31. The base arm 11 has integrated mounting hooks 17 for mounting the modular pants hanging unit to a vertical base plate 41, shown in FIG. 15, to assemble multiple module pants hanging units into pants hanging array as shown in perspective view in FIG. 16. The mounting hooks 17 for each modular pants hanging unit are inserted into receiving slots 42 on the base plate 41 as shown in FIG. 13. The base plate may be secured to a vertical surface and extends each modular pants hanging unit horizontally.

Figure 17:
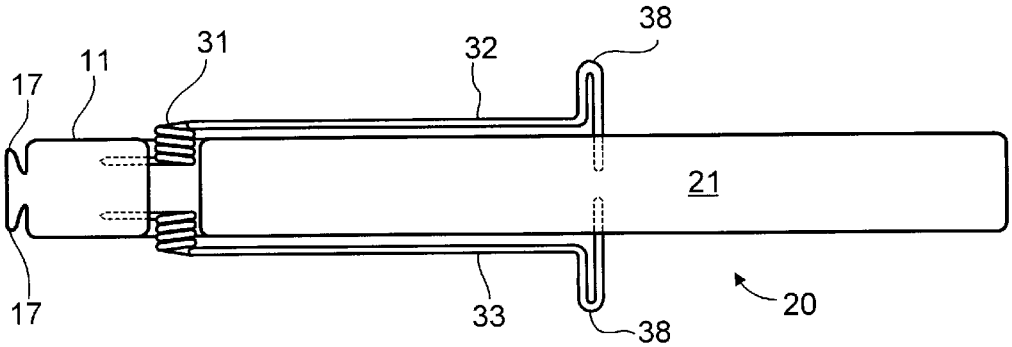
FIG. 17 shows the pants hanger of FIG. 14 in profile with the additional feature of pushing levers integrated into the spring element.

FIG. 17 shows an optional enhancement which shows an alternative to pushing tabs 26 shown in FIGS. 7 and 8. Specifically, spring element 31 is provided with integral pushing levers 38 near its connections with gripping arm 21 to facilitate pushing gripping arm 21 away from base arm 11 during insertion of a garment.

Figure 18:
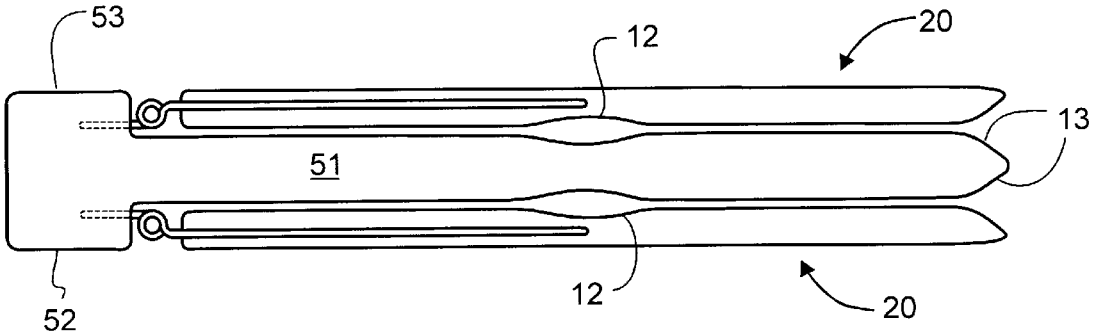
FIG. 18 shows another embodiment of the pants hanger of FIG. 1 having a central common base arm and two gripping arm assemblies-one on each side of the base arm.

FIG. 18 shows the present invention extended to include a horizontally extended common base arm 51 which has recess regions 12 and sloped regions 13 on its left and right sides. Common base arm 51 receives two gripping arm assemblies 20. One gripping arm assembly 20 is positioned parallel to the left side of the common base arm 51 and is permanently imbedded to the rear left region 52, as discussed above with respect to FIG. 3. The second gripping arm assembly 20 is positioned parallel to the right side of the common base arm 51 and is permanently imbedded to the rear right region 53. This embodiment reduces part count and increases pants hanging density.

Figure 19:
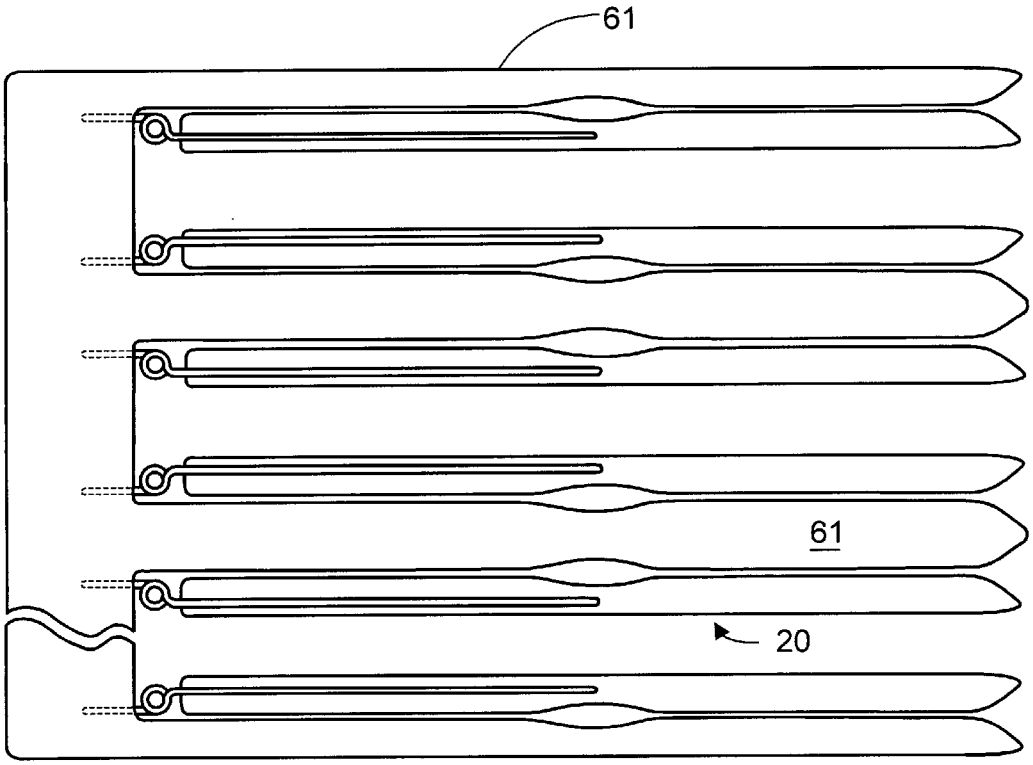
FIG. 19 shows an array of pants hangers such as those of FIGS. 1, 8, 11 and 18, in which the base arms and/or common bases arms are all formed integrally as a unit.

FIG. 19 shows the modular pants hanging unit further extended to include an integrated base arm 61 which has at least one base arm 11 and/or common base arm 51 integrated into integrated base arm 61 to receive multiple gripping arm assemblies 20.

Figure 20:
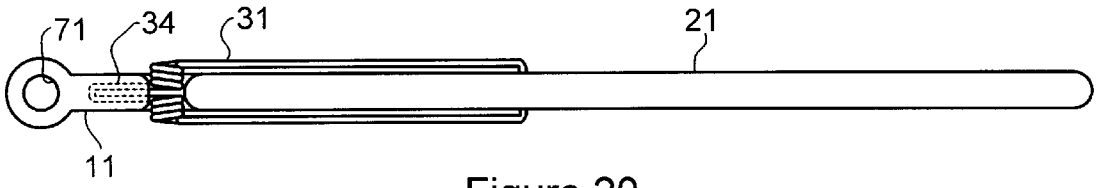
FIG. 20 shows a top view of another embodiment which may be mounted to a pole in which the gripping arm is disposed above the base arm.

FIG. 20 shows a top view of another embodiment which disposes gripping arm 21 on top of base arm 11. Although this embodiment may be mounted to a vertical surface, such as a wall, other surface, such as a shelf, or used to assemble into pants hanging array for hanging multiple pairs of pants on wall or under closet shelf, a possible enhancement is shown in conjunction with this embodiment which includes a hole 71 extending through the rear portion of the base arm to allow the base arm to be mounted to a vertically extending pole (not shown). In this manner, the base arm will be permitted swing around such pole. If desired, locking means (not shown) can be provided to ensure each hanger unit is disposed at a fixed angle with respect to the hanger above and below. Such a locking means may include a set screw or other known means of fixing each hanger to the pole. Alternatively, engaging teeth or other cooperating shapes formed on abutting surfaces of adjacent hangers may be employed. This would especially useful to display garments in a retail environment and would ensure even distribution of weight around the vertical pole as well as provide a pleasing visual effect.

Figure 21:
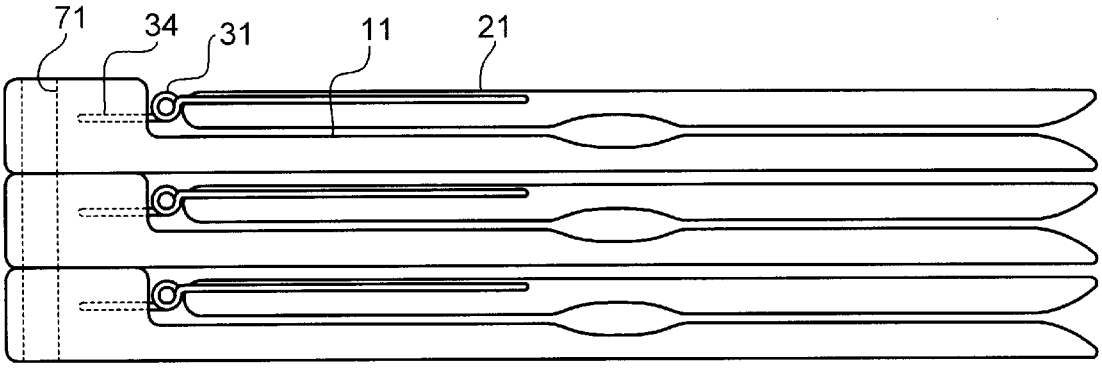
FIG. 21 shows a plurality of units according to the embodiment shown in FIG. 20 aligned to be mounted to a vertically extending pole.

FIG. 21 shows a plurality of the units shown in FIG. 20 with each unit's hole aligned with the other units' holes. Another possible enhancement shown in conjunction with this embodiment is moving the connection of spring element 31 to gripping arm 21 back slightly so that the holes 24 and 25 (see FIG. 3) in gripping arm 21 which receive terminals 36 and 37 (see FIG. 3) of spring element 31 are not placed in the narrow region of gripping arm 21 adjacent to the depression 22 (see FIG. 1). This repositioning of the connection between spring element 31 and the gripping arm 21, improves the strength of gripping arm 21 without significantly affecting the even distribution of pressure against a garment provided by gripping arm assembly 20.

Having now set forth the particular preferred embodiments of my invention, it is to be understood that scope of my invention is not defined by the detailed description above, but by the claims appended hereto.

What is claimed is:

1. A pants hanging unit comprising:

a substantially rigid, generally horizontally extending base arm and a first gripping arm assembly disposed on a first side of said base arm and a second gripping arm assembly as substantially a mirror image of said first gripping arm assembly on a side opposite said first side of said base arm, which is a common base arm for said first and second gripping arm assemblies;

each gripping arm assembly comprising;

a spring element connected at one end to a gripping arm at a pivot, said pivot comprising a mechanical connection between said sprint element and said gripping arm allowing each of said spring element and said gripping arm to independently rotate on a common axis at said pivot, and said spring element, at a second end of the spring element, being fixed to a rear portion of the base arm such that said gripping arm is supported by said spring element and said spring element biases the gripping arm toward the base arm.

2. A pants hanging unit as set forth in claim 1 wherein the inner surfaces of the base arm and the gripping arms have recess regions to accommodate a thicker seam portion of pants legs and the inner front end surfaces of the base arm and gripping arm have gradual slanting surfaces to facilitate pants insertion.

3. The pants hanging unit as set forth in claim 1 wherein said base arm is one of a plurality of integral base arms integrally formed with and extending from a common support.

4. The pants hanging unit as set forth in claim 3 further comprising at least one additional base arm having only a single gripping arm assembly connected to it.

5. A pants hanging unit as set forth in claim 1, wherein each said gripping arm further comprises at least one pushing tab attached to said gripping arm to facilitate separation of said gripping arm from said base arm when hanging a garment.

6. A pants hanging unit as set forth in claim 1, wherein each said spring element further comprises a pushing lever formed with said spring element to facilitate separation of each gripping arm from said base arm when hanging a garment.

7. A pants hanging unit as set forth in claim 1 wherein the spring element of each gripping arm assembly cooperates with a slot formed on a corresponding one of said gripping arms allowing said spring element to slide alone said slot thereby allowing said gripping arm to slide on said spring element in a general direction of extension of said gripping arm; each base arm further comprising a ramp surface at a proximal end of said base arm corresponding to each gripping arm such that as said gripping arm is slid towards the proximal end of the corresponding base arm, said each gripping arm is pushed away from said base arm by a corresponding one of said ramp surfaces and returns to a gripping position when pulled forward.

8. A pants hanging unit as set forth in claim 1 wherein each said spring element biases a corresponding one of said gripping arm and said base arm together with sufficient force to support a garment by frictional force generated between said gripping arm and base arm and said garment.

9. A pants hanging unit as set forth in claim 1 wherein said pivot is disposed approximately halfway between a proximal end and distal end of said gripping arm so that said gripping arm exerts substantially even pressure along its length against said base arm.

10. A pants hanging unit as set forth in claim 9 wherein said pivot comprises a hole formed in said gripping arm which is engaged by a pin extending into said hole, said pin formed integrally with said spring element.

11. A pants hanging unit as set forth in claim 9 wherein said hole extends along said axis, and said axis extends substantially vertically.

12. A pants hanging unit as set forth in claim 1 wherein said gripping arm is substantially rigid, providing substantially even pressure along its length to any garment interposed between it and said base arm.

* * * * *